US006986473B2

(12) United States Patent
Jansohn et al.

(10) Patent No.: US 6,986,473 B2
(45) Date of Patent: Jan. 17, 2006

(54) ATOMIZER DEVICE AND METHOD FOR THE PRODUCTION OF A LIQUID-GAS MIXTURE

(75) Inventors: Peter Jansohn, Kuessaberg (DE); Alexander Ni, Baden (CH); Sasha Savic, Wettingen (CH)

(73) Assignee: ALSTOM Technology Ltd., Baden (CH)

( * ) Notice: Subject to any disclaimer, the term of this patent is extended or adjusted under 35 U.S.C. 154(b) by 114 days.

(21) Appl. No.: 10/616,295

(22) Filed: Jul. 10, 2003

(65) Prior Publication Data

US 2004/0060996 A1 Apr. 1, 2004

(30) Foreign Application Priority Data

Jul. 11, 2002 (DE) ..... 102 31 218

(51) Int. Cl.
*B05B 7/10* (2006.01)
*B05B 7/06* (2006.01)

(52) U.S. Cl. ..... 239/398; 239/399; 239/403; 239/404; 239/405; 239/406; 239/424.5; 239/425.5

(58) Field of Classification Search ..... 298/398, 298/399, 403, 404, 405, 406, 424.5, 425.5, 298/427.3, 434, 434.5
See application file for complete search history.

(56) References Cited

U.S. PATENT DOCUMENTS

| | | | | |
|---|---|---|---|---|
| 3,533,558 A | | 10/1970 | Masters | |
| 3,684,186 A | * | 8/1972 | Helmrich | 239/400 |
| 3,980,233 A | * | 9/1976 | Simmons et al. | 239/400 |
| 4,179,068 A | | 12/1979 | Dombrowski | |
| 4,343,434 A | | 8/1982 | Haruch | |
| 4,754,922 A | * | 7/1988 | Halvorsen et al. | 239/5 |
| 5,044,559 A | * | 9/1991 | Russell et al. | 239/406 |

FOREIGN PATENT DOCUMENTS

| | | |
|---|---|---|
| DE | 27 53 788 | 6/1978 |
| DE | 197 30 617 A1 | 1/1999 |
| EP | 0 990 801 A1 | 4/2000 |
| FR | 904 557 | 11/1945 |

OTHER PUBLICATIONS

Search Report from EP 03 40 5488.2 (Nov. 17, 2004).

* cited by examiner

*Primary Examiner*—Davis Hwu
(74) *Attorney, Agent, or Firm*—Cermak & Kenealy, LLP; Adam J. Cermak

(57) ABSTRACT

In an atomizer device for the production of a liquid-gas mixture (4), the mixture (4) is introduced, particularly for compression, into a nozzle arrangement (3) in which the kinetic energy of the mixture (4) is in large part converted into compression energy by a pressure rise of the air.

The atomizer device (2) includes a central air feed (16) and a nozzle chamber (18) for the supply of liquid surrounding the air feed. At or in the atomizing device, means (17) are arranged in the nozzle chamber for producing a swirled liquid flow in the nozzle chamber (18), and the swirled liquid flow emerges via a nozzle aperture (19) surrounding the air feed.

4 Claims, 2 Drawing Sheets

ATOMIZER DEVICE AND METHOD FOR THE PRODUCTION OF A LIQUID-GAS MIXTURE

FIELD OF THE INVENTION

The invention relates to a device for the production of a liquid-gas mixture according to the preamble of the first claim.

The invention likewise relates to a method for the production of a liquid-gas mixture according to the preamble of the independent method claim.

DESCRIPTION OF PRIOR ART

From EP 0 990 801 is known an atomizer device for the production of a liquid-gas mixture which is used in a method of isothermal compression. The isothermally compressed gas, preferably air, is supplied to a gas turbine, the efficiency of which can thereby be improved. An atomizer device consists of plural annular nozzles arranged concentrically of one another and connected together by connecting channels. Air is supplied to the water emerging from the annular nozzles through apertures formed between the annular nozzles. The atomizer nozzle covers the whole aperture of the Laval nozzle, in order to form over the whole aperture a homogeneous spray cloud consisting of individual liquid droplets. A further atomizer nozzle likewise consists of plural annular nozzles arranged concentrically of one another, connected together by connecting channels and covering the aperture of the Laval nozzle. The feed of water and air is adjusted here, however, so that a foam-like mixture is formed in which air bubbles are enclosed by liquid.

SUMMARY OF THE INVENTION

The invention has as its object to increase the efficiency of atomization in an atomizer device and in a method of the kind mentioned at the beginning.

According to the invention, this is attained by means of the features of the independent claims.

The core of the invention is thus that the atomizer device consists of a nozzle member which includes an at least approximately central pipe for the gaseous medium and a nozzle chamber for feeding liquid, surrounding this central pipe, the liquid feed having means for the production of a swirled liquid flow in the nozzle chamber, and the swirled flow, emerging from the nozzle member through a nozzle opening, coaxially enclosing the gaseous medium.

Thus a swirling spray of hollow conical form is produced at the nozzle aperture of the atomizer device by means arranged on or in the atomizer device for producing a swirled liquid flow. Gaseous medium is fed into the reduced pressure zone in the interior of the hollow conical shaped spray via the central pipe.

The advantages of the invention are, among other things, that the liquid emerging from the atomizer device into a swirling flow forms a central reduced pressure zone into which a larger amount of gas flows than in atomizer nozzles known heretofore. The efficiency of the overall system is also increased by increasing the amount of entrained gaseous medium. The atomizing quality is increased by the improved atomization due to the hollow conical shaped spray and the smaller thickness of the liquid film emerging from the annular nozzle aperture. The improved atomization leads in its turn to the possibility of reducing the length of the Laval nozzle, since a shorter mixing time is required for the production of a bubbly mixture.

Further advantageous embodiments of the invention will become apparent from the independent claims.

BRIEF DESCRIPTION OF THE DRAWINGS

Embodiment examples of the invention are explained in detail hereinafter, using the drawings. Like elements are given the same reference numerals in the different Figures. The flow direction of the media is indicated by arrows.

Only those elements essential for the immediate understanding of the invention are shown.

DESCRIPTION OF PREFERRED EMBODIMENTS

Figure 1:
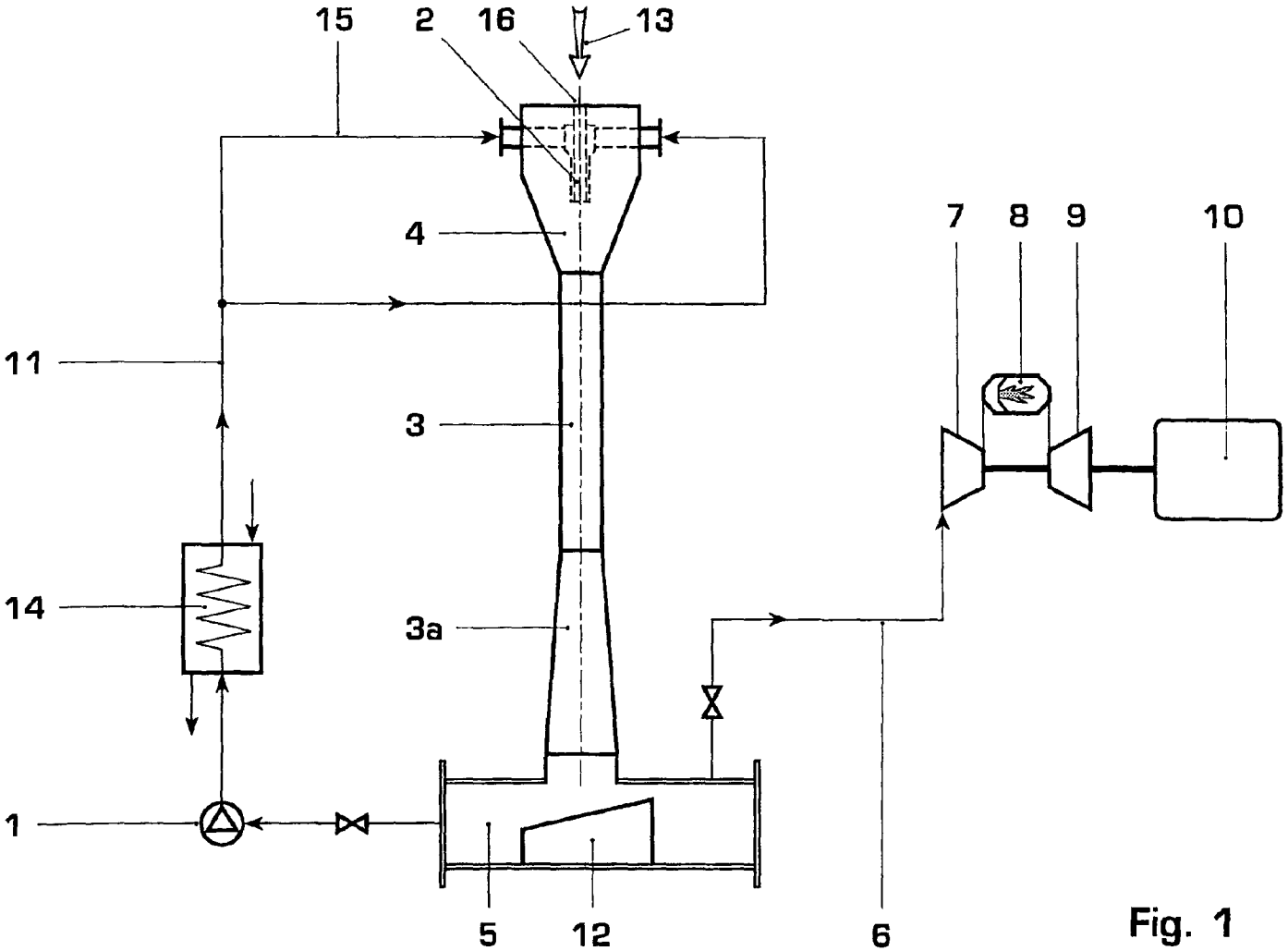
FIG. 1 is a schematic diagram of a gas turbine plant with preceding isothermal compression.

According to FIG. 1, isothermal compression is used for precompression in a schematically shown gas turbine plant. Water 15, either from a high-level reservoir or, as shown, pressurized by means of a water pump 1, is supplied via a water duct 11 to an atomizer device 2, is atomized in the nozzle inlet region of a mixing pipe 3 in the atomizer device 2 to a liquid-air mixture 4 with the addition of air 13 supplied by means of a feed duct 16, and is obtained in very finely divided small liquid droplets. The mixing pipe 3 is constituted as a vertically arranged drop shaft through which the liquid-air mixture 4 flows vertically downward, accelerated by gravity. In the region of the tapering internal contour of the diffuser 3*a*, kinetic energy is withdrawn from the liquid droplets, by means of which the air contained in the liquid-air mixture 4 is compressed. The diffuser 3*a* is connected downstream to a high pressure chamber 5 in which the highly compressed air is separated from the liquid in an air/water separator 12. The isothermally precompressed air is supplied via a corresponding high pressure duct 6 to a further compressor stage 7, which is connected in succession to a combustion chamber 8 in which fuel mixed with the precompressed air is ignited. The hot gases expanding in the combustion chamber drive the turbine 9 which is connected in its turn to a generator 10 for current production. The separated water is fed back again to the atomizer device 2 by means of the pump 1 and the water duct 11. For cooling the supplied water, this can be cooled by means of a water cooler 14 arranged in the water duct 11.

Basically it is to be recorded that the length of the mixing pipe 3 required for compression does not depend on the power of the gas turbine, but depends very strongly on the quality of atomization with which the atomizer device 2 atomizes the liquid into very fine liquid droplets. The length likewise depends on the nozzle efficiency and also on the pressure ratio with which the liquid to be atomized is supplied to the atomizer device 2. Thus the length of the mixing pipe 3 decreases with decreasing droplet diameter or decreasing compression efficiency. Typical nozzle lengths are 20 m at moderate atomization quality, as against which nozzle lengths can be shortened to 6–10 m at higher atomization quality. For the use of a gas turbine, the air mass throughflow of which is about 400 kg per second, typical inlet nozzle apertures of 2 m and outlet diameter of about 3 m are possible for Laval nozzles. Basically it is also possible to combine gas turbines, steam turbines, and also exhaust gas recuperators together with isothermal compression. It is furthermore to be recorded that the use of isothermal compression leads to a marked rise of the power density and also of the efficiency of gas turbines, compared with single-stage cooled systems. Further embodiments and arrangements can be gathered from EP 0 990 801 A1, which is incorporated herein by reference.

Figure 3:
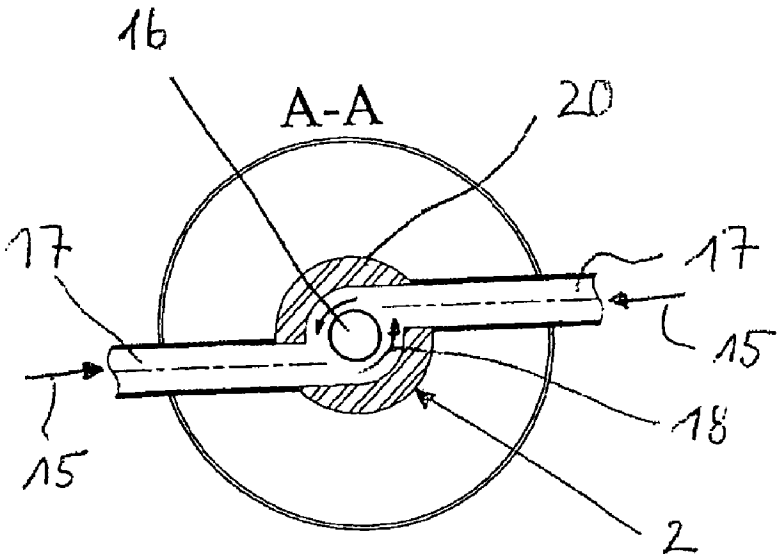
FIG. 3 is a partial cross section through the atomizer device along the line A–A of FIG. 2.
Figure 2:
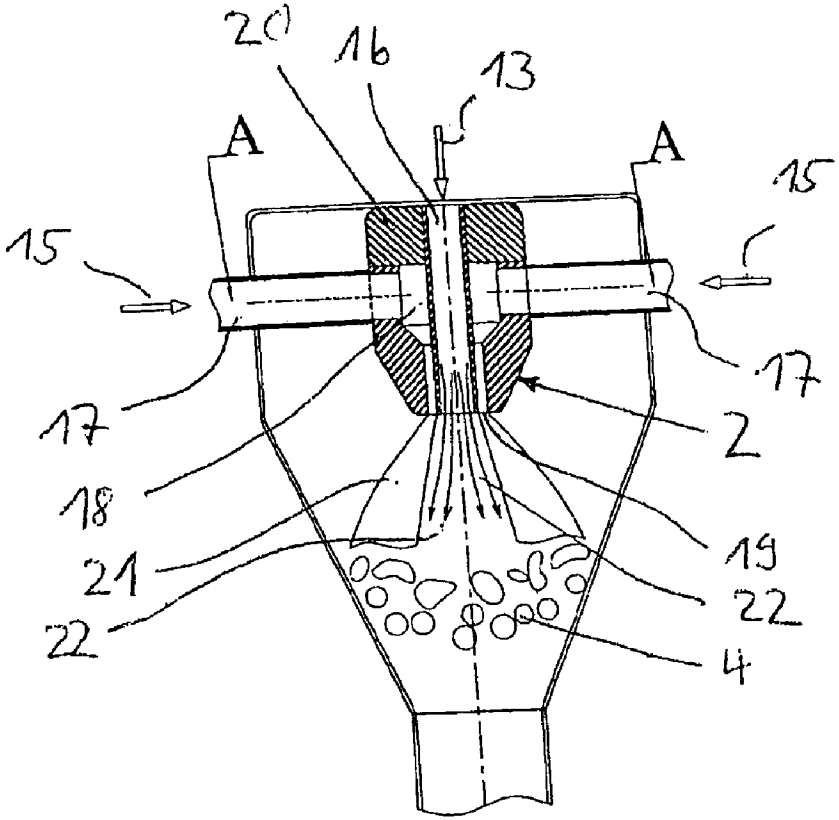
FIG. 2 is a partial longitudinal section through an atomizer device.

The atomizer nozzle 2 is shown in longitudinal section in FIG. 2 and in cross section in FIG. 3. In a nozzle member 20, the water 15 is conducted to the annular nozzle chamber 18 surrounding the air feed duct 16 by means of water feed ducts 17 running tangentially of the central air feed 16. The nozzle chamber is tapered toward the annular nozzle aperture 19. Water 15 is forwarded through the water feed ducts 17 to the nozzle chamber 18 by means of the pump 1. Because of the tangential introduction of the water into the nozzle chamber 18, a swirled flow is formed which is further accelerated in the tapering cross section toward the nozzle outlet aperture 19. On leaving the atomizer device 2, a spray 21 of hollow conical form arises which forms a reduced pressure zone 22 in the region which it encloses. Air 13 is sucked in via the air feed and entrained by this reduced pressure zone 22. The amount of air entrained by means of the pressure zone is clearly higher than in heretofore known atomizer nozzles. Directly at the nozzle outlet 19, the spray 21 is still a liquid film, which is subjected to strong surface tension forces, leading to instabilities because of the large specific surface. This leads to rapid atomization downstream of the nozzle aperture. The well atomized spray 21 is mixed with the entrained air 13 and forms a two-phase mixture 4 of air and liquid. As described hereinabove, the mixing process requires a given length, and the efficiency of mixing is inversely proportional to the drop size, i.e., the smaller the drops the higher is the efficiency. With an appropriate residence time in the Laval nozzle, the mixing leads to a bubbly mixture in which the air is enclosed in liquid droplets, which in turn leads to isothermal compression of the air. Due to the large quantity of entrained air, the high atomization quality, and the short mixing time for the production of the bubbly mixture, the height of the Laval nozzle can therefore be greatly reduced.

The invention is of course not limited to the embodiment example described and illustrated. For the production of the swirl flow in the nozzle chamber, only one tangential water feed, or more than two tangential water feeds, can be used. The design of the tangential water feeds with respect to their position and their internal dimensions takes place corresponding to the desired external angle of the spray, the desired amount of entrained air, the available water pressure and the flow rate of the water. In the region of the nozzle chamber, other means for producing a swirled liquid flow can be arranged in the nozzle chamber, e.g., deflecting channels arranged in or outside the nozzle chamber.

LIST OF REFERENCE NUMERALS

1 water pump
2 atomizer device
3 mixing pipe
3*a* diffuser
4 liquid-air mixture
5 high pressure chamber
6 high pressure feed duct
7 compressor
8 combustion chamber
9 turbine
10 generator
11 water duct
12 air/water separator
13 air
14 water cooler
15 water
16 air feed
17 tangential water feed
18 nozzle chamber
19 nozzle aperture
20 nozzle member
21 hollow conical form spray
22 reduced pressure zone

What is claimed is:

1. An atomizer device for the production of a liquid-gas mixture, the mixture useful for being introduced for the purpose of compression into a nozzle arrangement in which the kinetic energy of the mixture is in large part converted into compression energy of the gaseous component, the atomizer device comprising:

a nozzle member having an at least substantially central pipe for the gaseous medium, a rotationally symmetrical nozzle chamber surrounding the pipe for the liquid medium, and a nozzle aperture;

a liquid feed having means for producing a swirled liquid flow in the nozzle chamber;

wherein the nozzle aperture coaxially encloses the pipe; and wherein the liquid feed opens tangentially into the nozzle chamber.

2. An atomizer device according to claim 1, wherein the nozzle aperture is annular, and the nozzle chamber tapers to the annular nozzle aperture.

3. A method for the production of a liquid-gas mixture by an atomizer device, the mixture produced useful for being introduced into a nozzle arrangement in which the kinetic energy of the mixture is in large part converted into compression energy of the gaseous component, the method comprising:

causing a swirled liquid flow to emerge from a nozzle aperture of the atomizer device to produce a swirling hollow conical spray expanding in a flow direction, and to produce a reduced pressure zone within the spray; and causing the gaseous medium to enter the reduced pressure zone via a central feed; and introducing the swirled liquid flow in the nozzle chamber through at least one liquid feed opening tangentially into the nozzle chamber.

4. A method according to claim 3, comprising:

producing the swirled liquid flow in a nozzle chamber surrounding the central feed.

* * * * *